US006682000B1

(12) United States Patent
Apple

(10) Patent No.: US 6,682,000 B1
(45) Date of Patent: Jan. 27, 2004

(54) MISTING UMBRELLA

(76) Inventor: Phillip C. Apple, R.D. #1, Box 72A, Mount Pleasant Mills, PA (US) 17853

( * ) Notice: Subject to any disclaimer, the term of this patent is extended or adjusted under 35 U.S.C. 154(b) by 0 days.

(21) Appl. No.: 10/354,874

(22) Filed: Jan. 30, 2003

(51) Int. Cl.[7] ..... B05B 15/00
(52) U.S. Cl. ..... 239/289; 239/273; 239/16; 239/17
(58) Field of Search ..... 239/16, 17, 289, 239/273, 280

(56) References Cited

U.S. PATENT DOCUMENTS 2,005,602 A * 6/1935 Thomson ..... 239/18
2,727,366 A * 12/1955 Hagen ..... 62/304
2,758,418 A * 8/1956 Troppe ..... 446/197
4,928,718 A 5/1990 Apple
5,000,384 A * 3/1991 Arnold ..... 239/128
5,020,557 A 6/1991 Apple
5,143,107 A * 9/1992 Kelley ..... 135/16
5,156,339 A 10/1992 Gibson et al.
5,299,588 A * 4/1994 MacLeod ..... 135/16
5,322,342 A 6/1994 Gange
5,337,989 A 8/1994 Apple
5,613,731 A 3/1997 Aspinall
5,711,332 A 1/1998 Apple
5,722,596 A 3/1998 Dome
5,823,617 A 10/1998 Schafer
5,979,793 A * 11/1999 Louis ..... 239/128
6,158,669 A * 12/2000 Louis ..... 239/146

* cited by examiner

*Primary Examiner*—Christopher Kim
(74) *Attorney, Agent, or Firm*—Thomas R. Shaffer, Esq.

(57) ABSTRACT

The present invention provides an umbrella fan which includes a pole, an upper hub, main umbrella support members, a lower hub, lower umbrella support arms and a main umbrella fabric cover attached to the main umbrella support members. At least one misting element is attached to the main umbrella support members to direct a misting spray downwardly to an area under the fabric cover of the umbrella.

9 Claims, 5 Drawing Sheets

MISTING UMBRELLA

BACKGROUND OF THE INVENTION

1. Field of the Invention

The present invention relates to a misting umbrella. More specifically, it relates to a umbrella which has at least one misting element attached to direct a spray of water downwardly to an area under a main umbrella fabric cover.

2. Description of the Prior Art

A variety of umbrellas have been proposed. Many types and styles of umbrellas exist but none have been heretofore proposed which provide a misting element which directs a spray of water downwardly to an area under a main umbrella fabric cover. A number of different inventors have proposed the provision of misting elements on lounge chairs and the like to cool persons lying in the sun. See for example, Schafer, U.S. Pat. No. 5,823,617; Dome, U.S. Pat. No. 5,722,596; Aspinall, U.S. Pat. No. 5,613,731; Gibson, et al., U.S. Pat. No. 5,156,339 and Gange, U.S. Pat. No. 5,322,342. While such devices do provide some cooling to the individual, lying in the sun can be hazardous with risks of sun burn and even skin cancer.

The primary purposes of umbrellas over their many years of existence has been to provide shade and to provide shelter from rain. Thus, one on the main purposes of an umbrella is being challenged and contradicted by the present invention. Rather than providing an umbrella to shelter a person from the rain, the umbrella is being utilized to provide shade and to actually apply water to such person for additional comfort and cooling.

There remains a need for an umbrella which is lightweight, collapsible, portable and which utilizes one or more misting elements to direct a spray of water downwardly to an area under a main umbrella fabric cover. With such an arrangement, protection from the dangerous rays of the sun is provided while allowing the at least one misting element to provide cooling for individuals seated or standing beneath the umbrella.

SUMMARY OF THE INVENTION

In its simplest form the present invention provides a misting umbrella comprising a pole; an upper hub; a plurality of main umbrella support members; a lower hub; a plurality of lower umbrella support arms; a main umbrella fabric cover attached to said main umbrella support members; and at least one spray member attached to at least one of said main umbrella support members, said at least one spray member directed downwardly and connected to a supply of water.

Preferably said at least one spray member comprises a plurality of spray members, each spray member attached to one of said main umbrella support members.

In the preferred embodiment of the invention a distribution ring provides a supply of water to plural distribution lines attached to said plurality of spray members. Said distribution ring preferably includes plural "T" shaped distributors connected to form a ring by plural ring lines and connected to one of said distribution lines. Preferably a main supply line provides a supply of water from a pump to said distribution ring.

Said main supply line may be connected to said distribution ring by a "T" shaped distributor but is preferably connected to said distribution ring by an "X" shaped distributor.

Said supply of water is preferably comprised of tubular lines of a flexible material such a plastic, rubber or nylon. Said tubular lines preferably comprise a main supply line, ring lines and distribution lines.

Said distribution ring is preferably flexible so as to allows said main umbrella support members to be moved from an open to a closed position in a normal manner.

In the preferred embodiment of the invention a shut off valve is also provided to allow intermittent use of said at least one spray member at desired intervals.

DETAILED DESCRIPTION OF THE PREFERRED EMBODIMENTS

Figure 1:
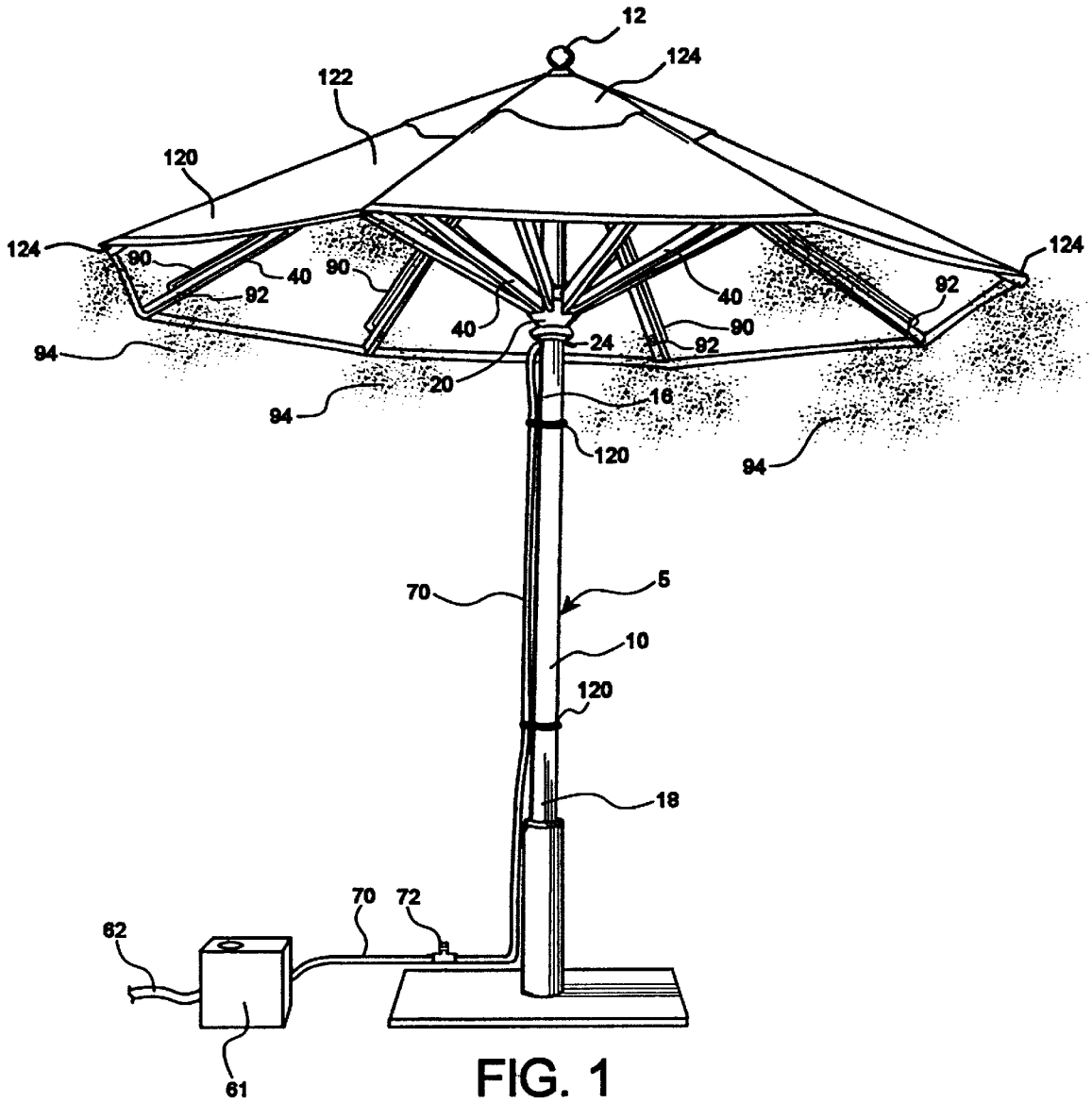
FIG. 1 is an isometric view of a misting umbrella of the present invention in an open position.

Referring to the Figures, the umbrella 5 includes a pole 10. Pole 10 has an upper end 16 and a lower end 18. A cap 12 is provided on upper end 16 of pole 10. The cap 12 is secured to upper end 16 of pole 10 by means of a cap screw 14. A hole 19 is provided from pole 10 for a pin 24 which will be described in greater detail hereinafter.

An upper hub 30 is provided which includes notches 32 for pivotal mounting of main umbrella support members 40. Main umbrella support members 40 are provided which each include an inner portion 42, a central portion 46 and an outermost portion 44. The innermost portion 42 of main umbrella support member 40 is pivotally attached in notch 32 of hub 30. Outermost portion 44 of main umbrella support member 40 are secured within a pocket 124 of a main umbrella fabric cover 120. A lower support block 20 is provided which is held in position against downward movement by lower support block pin 24 which, as previously indicated, is inserted through hole 19 and the lower end 18 of pole 10. A lower hub 50, which includes notches 52, is also provided. A plurality of lower umbrella support arms 60 having a first end pivotally attached to in notches 52 of lower hub 50 and having a second end pivotally attached to central portion 46 of main umbrella support members 40. Each of these connections are pivotal connections which allows the umbrella to be opened and closed between an open position and a closed position in the well known manner.

Figure 2:
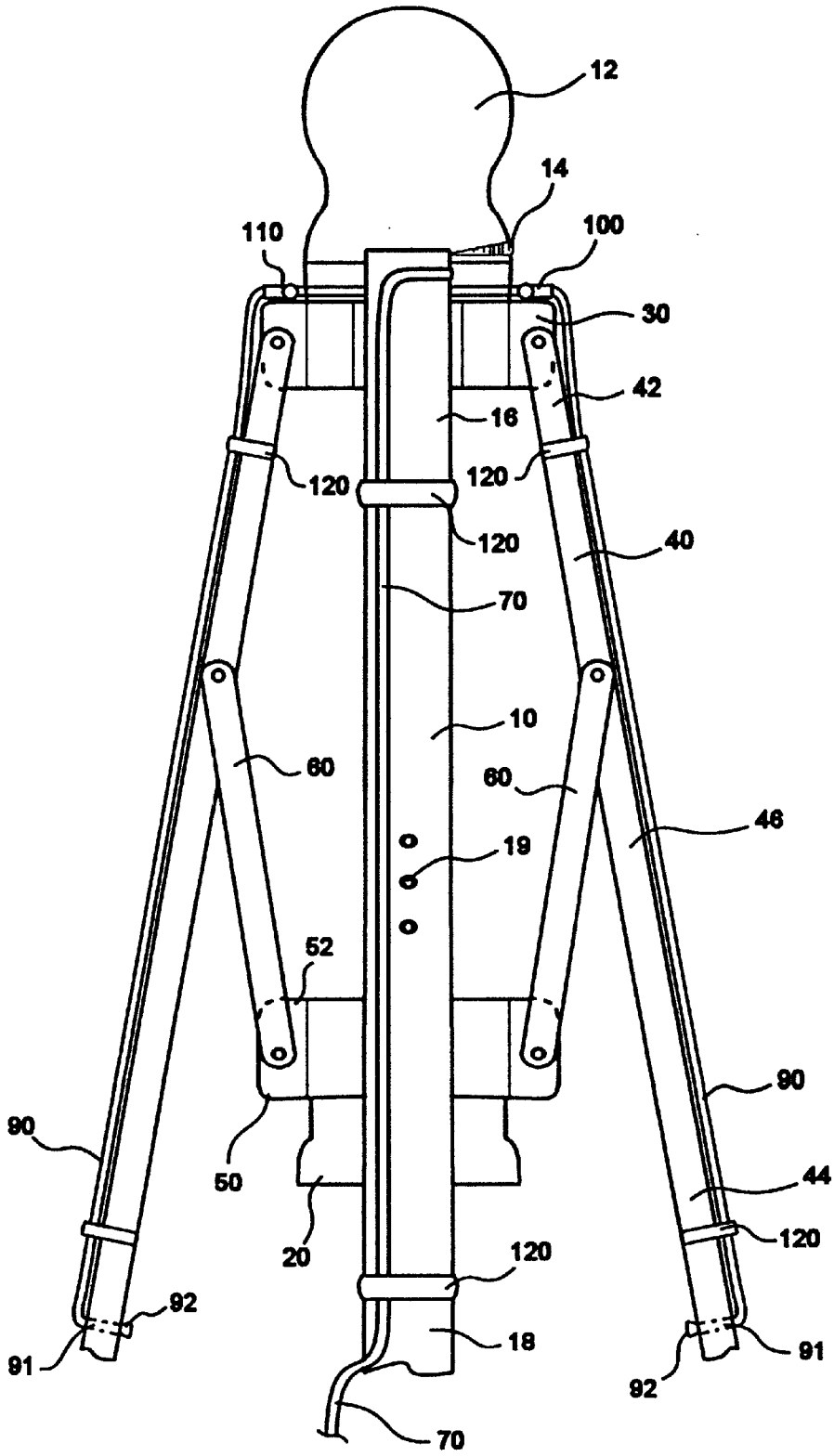
FIG. 2 is a cross sectional view of an umbrella of the present invention in a closed position.
Figure 3:
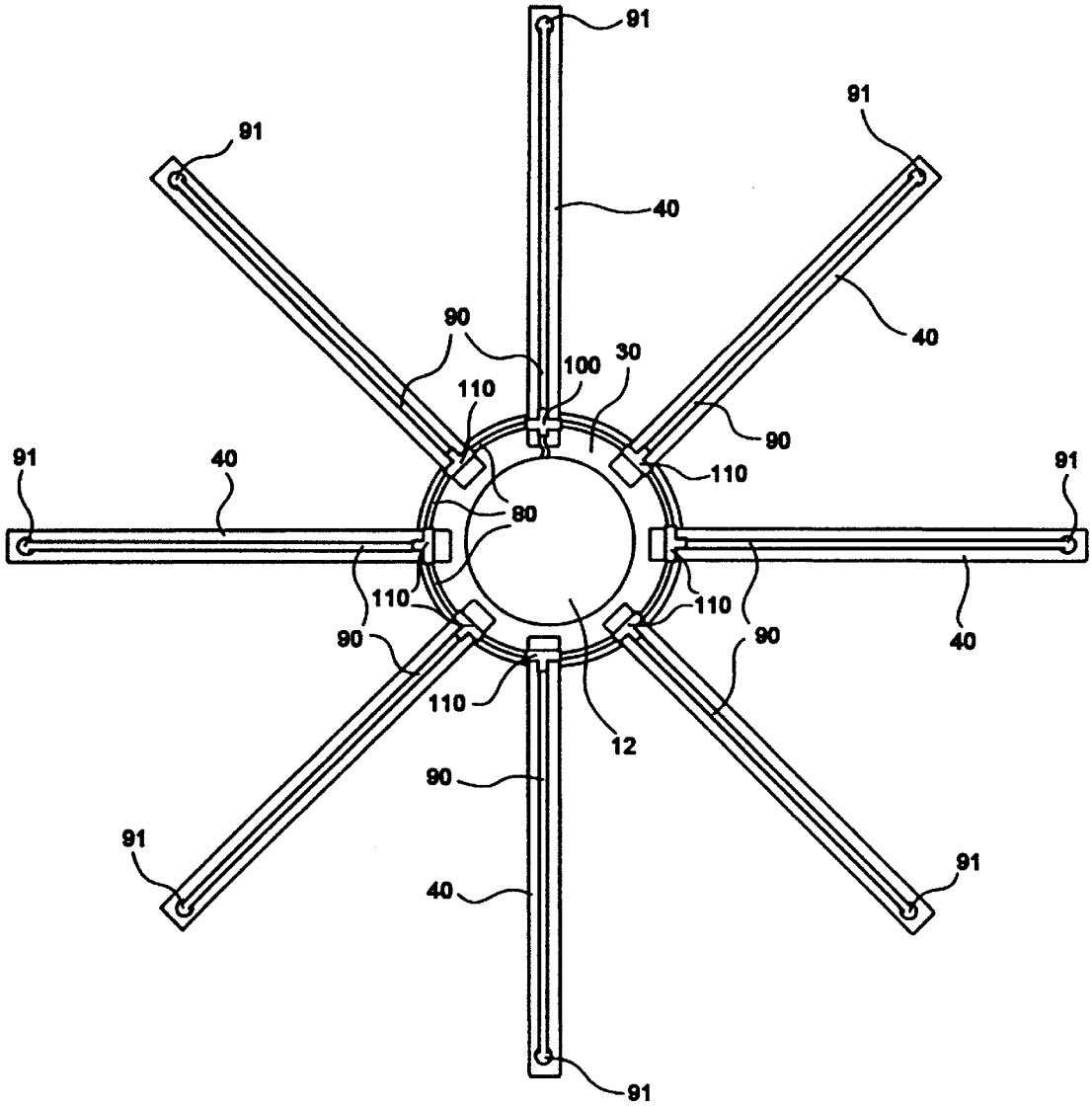
FIG. 3 is a top view of a misting umbrella of the present invention with the fabric cover removed.

Referring to FIG. 1, it can be seen that a singular main umbrella fabric cover 120 is provided in the manner which is most commonly practiced with existing patio umbrellas. Such main umbrella fabric cover 120 is formed out of generally triangular segments 122 as shown in FIG. 2. These triangular segments 122 are sewn together. If desired, an additional piece of fabric 124 may be provided over a central portion of the main umbrella fabric cover 120. As shown in FIG. 1, each of the main umbrella support members 40 are attached within pockets 124 of the main umbrella fabric cover 120.

As will be obvious, the lower hub 50 is adapted for sliding motion on pole 10 allowing the umbrella to be moved from an open position to a closed position. Such operation is well known in the art.

Referring now to the operation of the mist generating portion of the invention, a pump 61 is provided which is connected to an electrical source (not shown). A supply of water is provided through a hose line 62. The output of the pump is provided to a main supply line 70. A shut-off valve 72 is provided preferably at a location near the base of pole 10 to allow a user to turn the mist on and off as desired. As shown, the main supply line 70 is attached to pole 10 by connectors 120. The main supply line 70 is connected tightly to the pole 10 and runs between the pole 10 and the lower support 20, lower hub 50 and upper hub 30.

Figure 4:
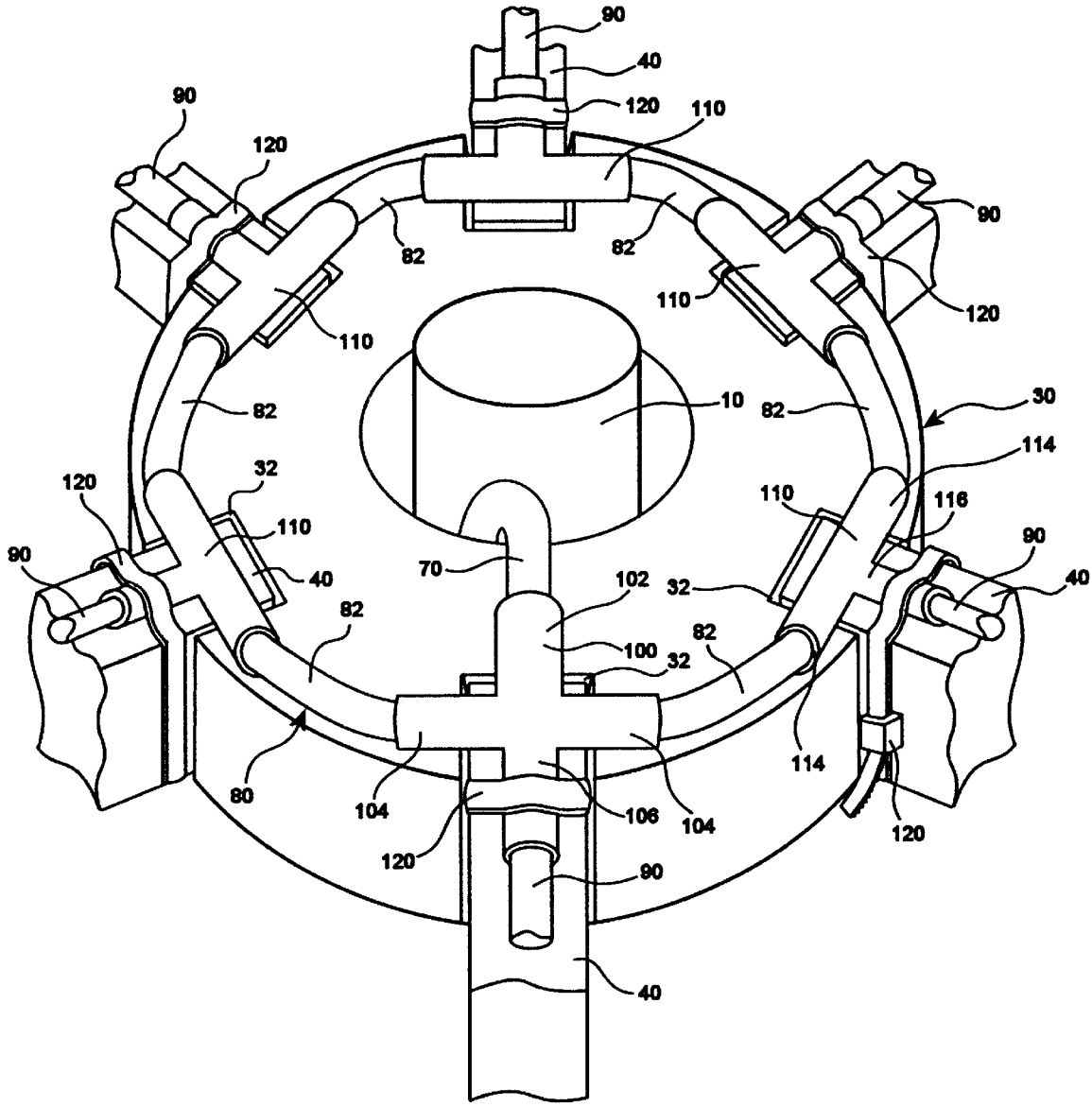
FIG. 4 is an isometric view showing the details of a distribution ring according to the present invention.
Figure 5:
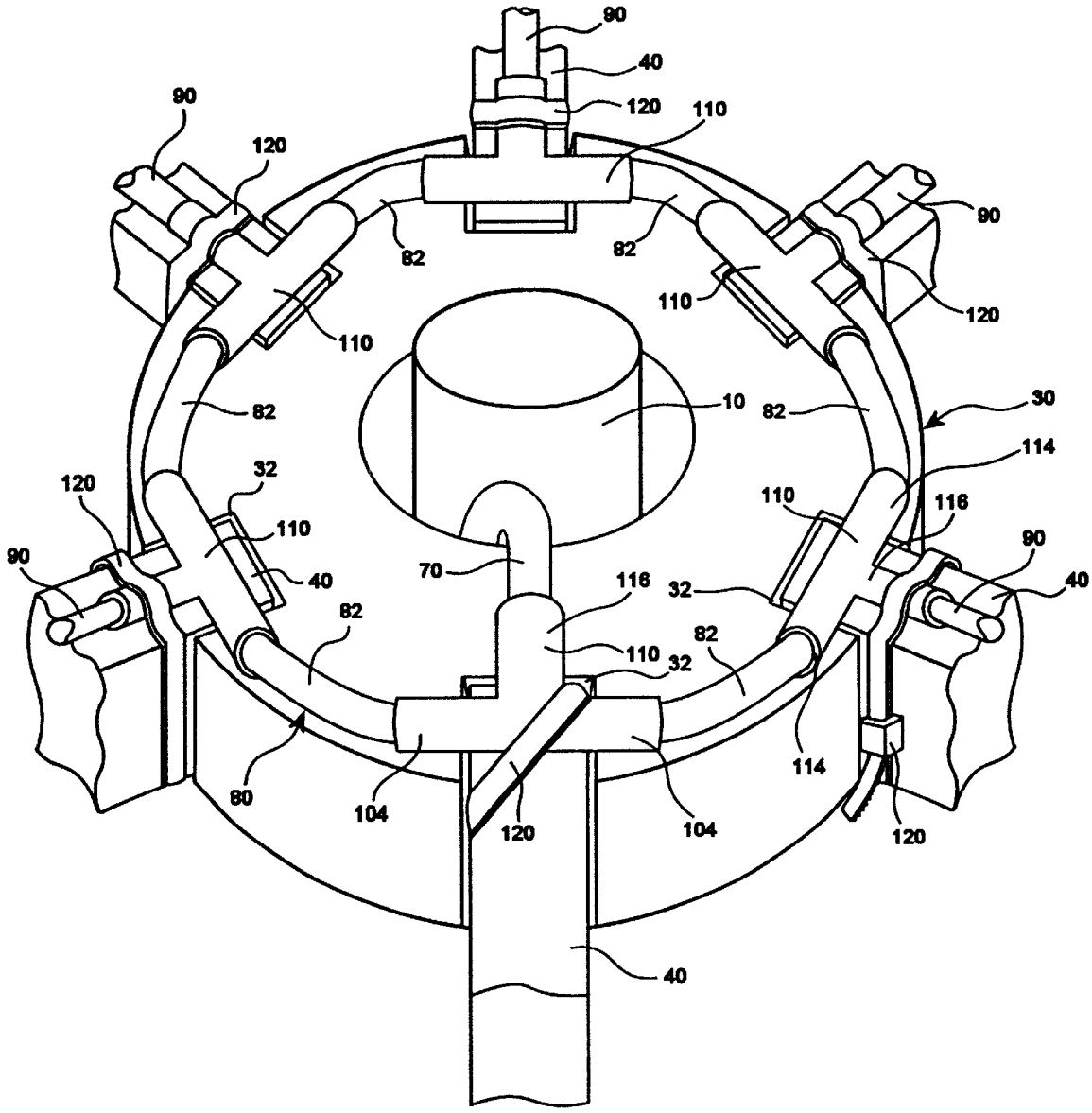
FIG. 5 is an isometric view showing a main supply line connected to said distribution ring by a "T" shaped distributor.

The main supply 70 is preferably connected to a distribution ring 80 which is formed of a number of individual water distributors as will be hereinafter discussed. Preferably, an "X" shaped distributor 100 is provided having an input end 102 connected to main supply line 70. Two lateral outputs 104 are connected respectively by ring lines 82 to "T" shaped connectors 110 as best shown in FIG. 4. The "X" shaped distributor 100 also has an output 106 which is connected directly to a distribution line 90 which carries the water directly to a spray member 92.

Each "T" shaped distribution member 110 has a pair of lateral outputs 114 which form a portion of the distribution ring 80 and have an output 116 which are connected to a distribution line 90. Each of the distribution members 100, 110 are attached to a main umbrella support member 40 by means of connectors 120 as best shown in FIG. 4. The distribution lines 90 pass through an opening 91 in the outer ends 44 of the main support 40 and are connected to spray members 92.

In use, once the pump 61 is turned on and valve 72 opened, water flows through main supply line 70, through distribution ring 80 to the distribution lines 90 and a spray is emitted downwardly by spray members 92. It will be obvious to those skilled in the art that a variety of different spray member configurations could be utilized to provide a fine mist or even a heavy shower, if desired. The spray is directed downwardly to an area beneath the umbrella fabric 120 as best shown in FIG. 1.

The present invention provides a lightweight and portable misting umbrella which provides both shade from the sun as well as a refreshing mist of water to provide for additional cooling to those located beneath the umbrella.

While I have shown and described the presently preferred embodiments of my invention, the invention is not limited thereto and may be otherwise variously practiced within the scope of the following claims:

1. A misting umbrella comprising:

a) a pole (10);

b) an upper hub (30);

c) a plurality of main umbrella support members (40);

d) a lower hub (50);

e) a plurality of lower umbrella support arms (60);

f) a main umbrella fabric cover (120) attached to said main umbrella support members (40); and g) at least one spray member (92) attached to at least one of said main umbrella support members (40), said at least one spray member (92) directed downwardly and connected to a supply of water wherein said at least one spray member comprises a plurality of spray members (92) each spray member (92) attached to one of said main umbrella support members (40) and wherein a distribution ring (80) provides a supply of water to plural distribution lines (90) attached to said plurality of spray members (92).

2. A misting umbrella according to claim 1 further comprising a shut off valve (72) to allow intermittent use of said at least one spray member (92) at desired intervals.

3. A misting umbrella according to claim 1 wherein said distribution ring (80) is flexible and allows said main umbrella support members (40) to be moved from an open to a closed position in a normal manner.

4. A misting umbrella according to claim 1 wherein said distribution ring includes plural "T" shaped distributors (110) connected to form a ring by plural ring lines 82, said "T" shaped distributors 1110) also connected to one of said distribution lines (90).

5. A misting umbrella according to claim 1 wherein a main supply line (70) provides a supply of water from a pump (61) to said distribution ring (80).

6. A misting umbrella according to claim 4 wherein said main supply line (70) is connected to said distribution ring by a "T" shaped distributor (110).

7. A misting umbrella according to claim 4 wherein said main supply line is connected to said distribution ring by an "X" shaped distributor (100).

8. A misting umbrella according to claim 1 wherein said supply of water comprises tubular lines of a flexible material.

9. A misting umbrella according to claim 8 wherein said tubular lines comprise a main supply line (70), ring lines (82) and distribution lines (90).

* * * * *